US007186017B2

(12) United States Patent
Kuo

(10) Patent No.: US 7,186,017 B2
(45) Date of Patent: Mar. 6, 2007

(54) BACKSTOP SOCKET STRUCTURE FOR LAMP STRING

(76) Inventor: Cheng-Ju Kuo, P.O. Box 96-405, Taipei 106 (TW)

( * ) Notice: Subject to any disclaimer, the term of this patent is extended or adjusted under 35 U.S.C. 154(b) by 113 days.

(21) Appl. No.: 11/028,531

(22) Filed: Jan. 5, 2005

(65) Prior Publication Data

US 2006/0146578 A1 Jul. 6, 2006

(51) Int. Cl.
*H01R 33/00* (2006.01)

(52) U.S. Cl. ..... 362/654; 362/251; 362/806; 439/188

(58) Field of Classification Search ..... 362/654, 362/653, 652, 806, 656, 251, 249, 391; 315/122, 315/123, 125; 200/51.1, 51.09; 439/188, 439/619, 699.2
See application file for complete search history.

(56) References Cited

U.S. PATENT DOCUMENTS 1,536,332 A * 5/1925 Dam ..... 200/51.1
5,139,343 A * 8/1992 Lin ..... 362/654
6,257,740 B1 * 7/2001 Gibboney, Jr. ..... 362/288
6,609,814 B2 * 8/2003 Ahroni ..... 362/251

* cited by examiner

*Primary Examiner*—Renee Luebke
*Assistant Examiner*—Gunyoung T. Lee
(74) *Attorney, Agent, or Firm*—Troxell Law Office, PLLC

(57) ABSTRACT

A backstop socket structure to prevent a lamp string from turning-off upon a bulb dropped unintentionally, which comprises a fuse-type bulb mounted in a socket of a lamp string and a plurality backstop sockets; each backstop socket is furnished with two contact copper plates, which are furnished with two spring reeds in close contact state normally; the bulb base has a rod stub under the center of the bulb base; after the bulb base is plugged in place, the rod stub would push the two spring reeds separated from each other; in case of a bulb base being dropped or missing, the two spring reeds will be in close contact state as a result of the resilient force thereof so as to keep the lamp string in lighting up state.

4 Claims, 6 Drawing Sheets

BACKSTOP SOCKET STRUCTURE FOR LAMP STRING

BACKGROUND OF THE INVENTION

1. Field of the Invention

This invention relates to a lamp string for Christmas, and particularly to a backstop socket structure to prevent a lamp string from turning-off upon a bulb dropped unintentionally.

2. Description of the Prior Art

The conventional Christmas lamp string is usually made of an elongate lamp string, which includes a plurality of separate lamp strings connected together; each separate lamp string includes a plurality of short power-supply wires connected between two sockets. The first bulb of the lamp string is connected, by using a longer wire, with the plug; the longer wire is twisted with the lamp string to form into a separate lamp string.

Each of the sockets in the lamp string is to be plugged with a connector, which is mounted with a bulb so as to facilitate the bulb to be replaced in case of being burned out. The number of sockets and the coefficient of resistance of each bulb are all pre-designed in accordance with the voltage and current of a given area.

The plug of each lamp string is furnished with a fuse to prevent the power-supply wire of the lamp string from being over-loaded. In case of the power-supply wire having a short circuit or being over-loaded, the fuse in the plug will be burned out automatically so as to avoid a hazard; however, the fuse furnished in the plug is not designed to prevent the socket from being overloaded.

The bulb plugged in the socket of each lamp string has two copper wires to be fixed in place with a positioning bead; the tail ends of the copper wires are mounted with a tungsten filament; the aforesaid parts are then mounted in a glass tube, of which both ends are to be sealed by means of different welding methods respectively so as to form into a bulb; the bulb is to be plugged in the socket of the lamp string. Since the sockets of the lamp string are connected one another in series, the whole lamp string is subject to having an open circuit and outage in the event of a tungsten filament being burned out.

In order to avoid the lamp string to turn off upon the tungsten filament of a bulb being burned out, an aluminum fuse of 0.065 m/m is wound around the two copper wires near the positioning bead; the number of turns of the fuse is designed in accordance with technical requirement, but it has at least 2.5 turns to enable the fuse to mount in place. The object of furnishing such a fuse is to maintain the whole lamp string to be in lighting-up condition in case of the tungsten filament being burned out; in that case, the fuse having lower resistance can still have the two copper wires maintained in conduction condition. The requirement of at least 2.5 turns of the aluminum fuse is to prevent the fuse from being burned out upon the current being not over a given value.

The aluminum fuse mounted between the two copper wires and near the positioning bead must have a resistance less than that of the tungsten; in case of the tungsten filament being burned out, the aluminum fuse can still maintain a current to flow through the two copper wires so as to avoid the lamp string to have an outage for a short time; however, since every bulb in the lamp string will lose at least a portion of the tungsten filament to share the power dissipation, the tungsten filaments of the rest bulbs will have a higher power dissipation; in other words, the serviceable life of the tungsten filament in the bulb will be reduced proportionally.

Whenever the number of bulbs in a lamp string is reduced gradually, the bulb number of bulbs, which are not lit up, will be increased. Since the power dissipation of every bulb is increased, the temperature thereof will also be increased; then, the temperature of the connector of each bulb will be increased to an over-loaded condition. Generally, the material used for making the connector and the socket will be improved to withstand a given high temperature; in that case, the cost for the material thereof will be increased without solving the problem of a single bulb in a lamp string to suffer from a high temperature.

In a conventional lamp string, if one bulb is dropped or missing, the whole lamp string will be turned off immediately.

SUMMARY OF THE INVENTION

The prime object of the present invention is to provide a backstop socket for a lamp string, in which the two contact copper plates are furnished with two spring reeds respectively, and the spring reeds are normally in close contact state; as soon as a bulb base is plugged into a backstop socket, the rod stud under the bulb base will push the two spring reeds separated from each other; in case of the bulb base being dropped or missing, the two spring reeds will restore in close contact state automatically to keep the lamp string in lighting up condition.

Another object of the prevent invention is to provide a backstop socket for a lamp string, in which the two contact copper plates are furnished with two spring reeds respectively, which are normally in close contact state; further, the lamp string is furnished with a fuse-type bulb which will be burned out in case of a given plurality of bulb bases being dropped or missing so as to prevent the lamp string from having further danger.

Still another object of the present invention is to provide a backstop socket for a lamp string, in which the two contact copper plates mounted in the backstop socket are furnished with two spring reeds (punched in shape) having different length; after the two contact copper plates are mounted into the copper-plate plug grooves of the backstop socket, the two spring reeds on the contact copper plates are in close contact state; as soon as the bulb base is plugged into the backstop socket, the rod stub under the bulb base will push one spring reed to separate from the other spring reed so as to having the power supply passed through the bulb to keep the lamp string in lighting up state.

DETAILED DESCRIPTION OF THE PREFERRED EMBODIMENT

Figure 1:
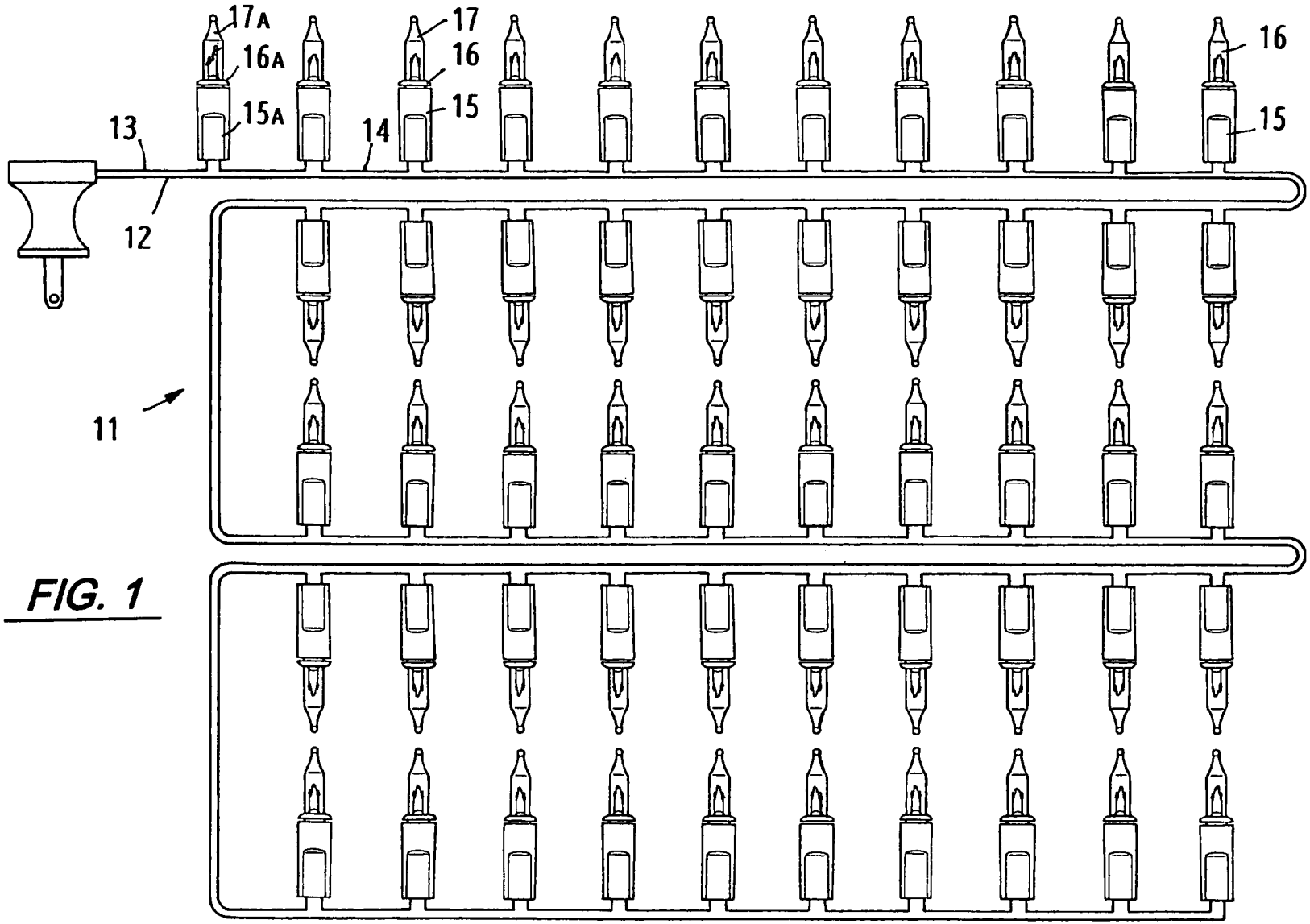
FIG. 1 is a plan view of a lamp string of the present invention.

This invention relates to a backstop socket structure to prevent a lamp string from turning off upon a bulb dropped unintentionally; as shown in FIG. 1, the lamp string 11 comprises a long power-supply wire 12, a shorter power-supply wire 13, a plurality of short power-supply wires 14, and a plurality of backstop sockets 15; each backstop socket 15 includes a bulb base 16 mounted with a bulb 17. In each lamp string 11, the bulb 17A in one backstop socket 15 is a fuse-type bulb. In case of a given number of bulb bases 16 in a lamp string 11 being dropped to ground or missing, the backstop socket 15 can automatically have the circuit connected so as to enable the lamp string to be lighted up continuously. If the number of the dropped bulb bases 16 is over the number as designed originally, the fuse-type bulb 17A will be burned out automatically without causing the safety of the lamp string.

Figure 2:
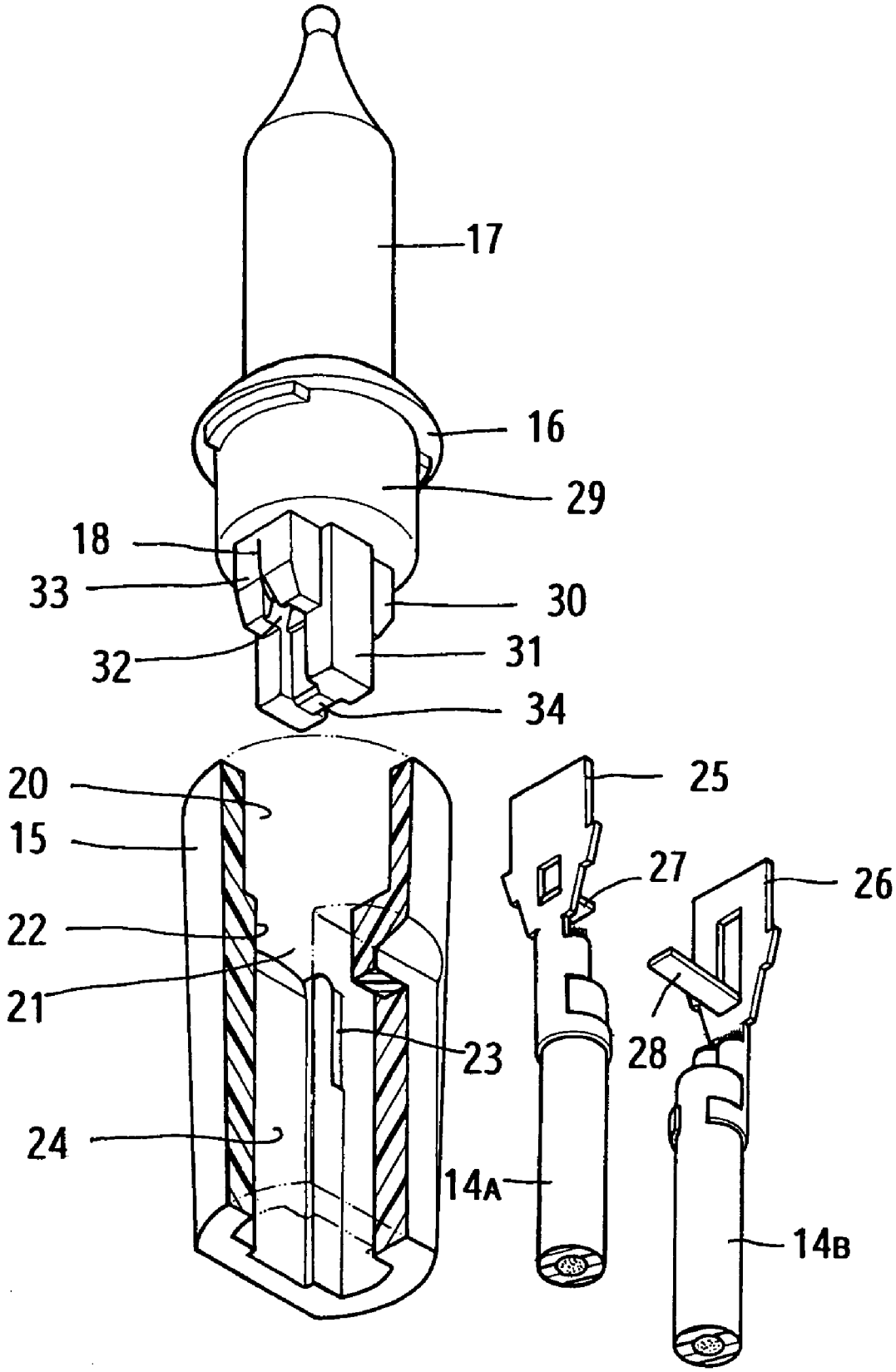
FIG. 2 is a disassembled view of the present invention, showing the relation among parts thereof.
Figure 3:
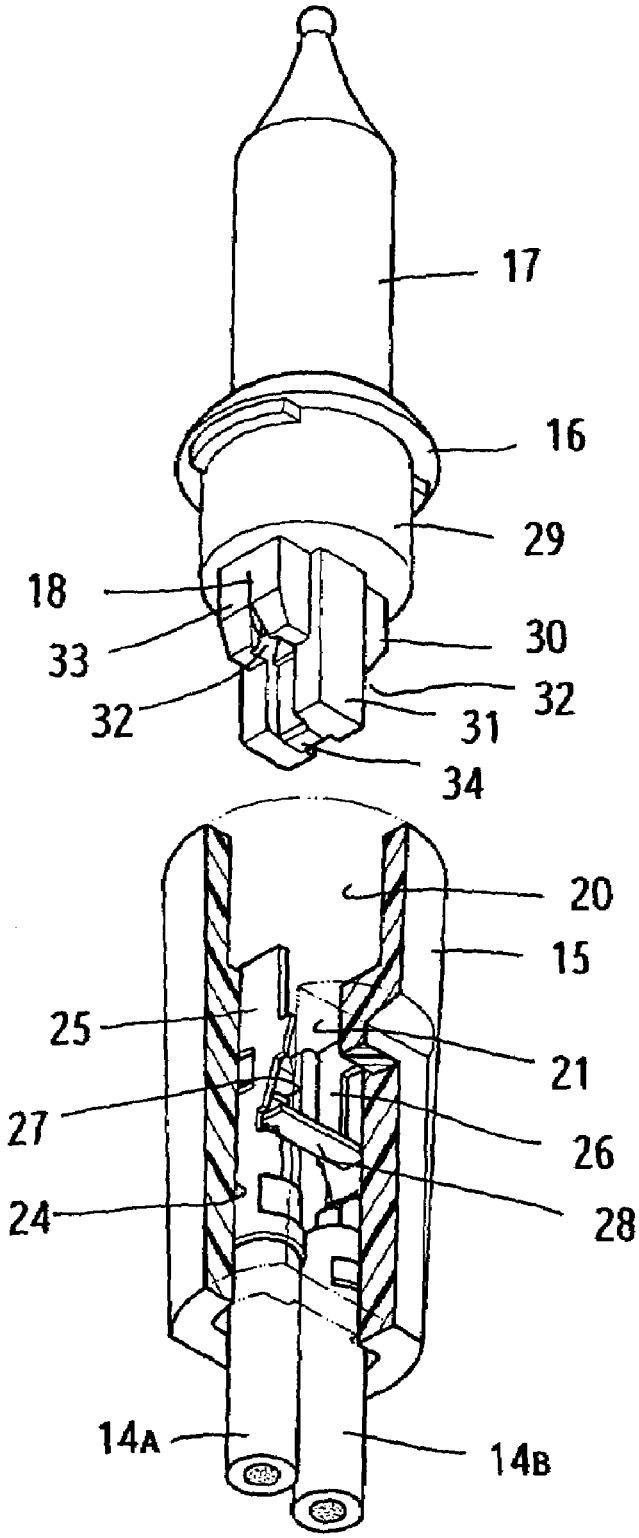
FIG. 3 is a disassembled view of the present invention, showing the bulb base separated from the backstop socket.

As shown in FIGS. 2 and 3, every backstop socket 15 in a lamp string 11 includes a plug cavity 20, a rectangular plug space 21 and a power-supply wire groove 24; the plug cavity 20 is designed to facilitate the cylinder member 29 of the bulb base 16 to plug in. Both sides of the rectangular plug space 21 are furnished with two copper-plate plug grooves 22 and 23 respectively to facilitate two contact copper plates 25 and 26 to plug in respectively. The power-supply wire groove 24 is under the rectangular plug space 21, and it is used for facilitating the short power-supply wires 24 of the two contact copper plates 25 and 26 to pull outwards.

The bulb base 16 is furnished with a plug cavity for receiving the bulb 17. The bottom of the plug cavity is furnished with two through holes 32 to facilitate the two copper wires 18 and 19 of the bulb 17 to pull out and to attach to two side surfaces 33. The center of the rectangular block 30 is furnished with a rod stub 31, which is to be plugged into the rectangular plug space 21 under the plug cavity 20 of the backstop socket 15; after the rod stub 31 is plugged in place, the end surface 34 of the rod stub 31 will touch and push the spring reed 28 of the contact copper plate 26 downwards until the spring reed 28 being separated from the spring reed 27.

Figure 4:
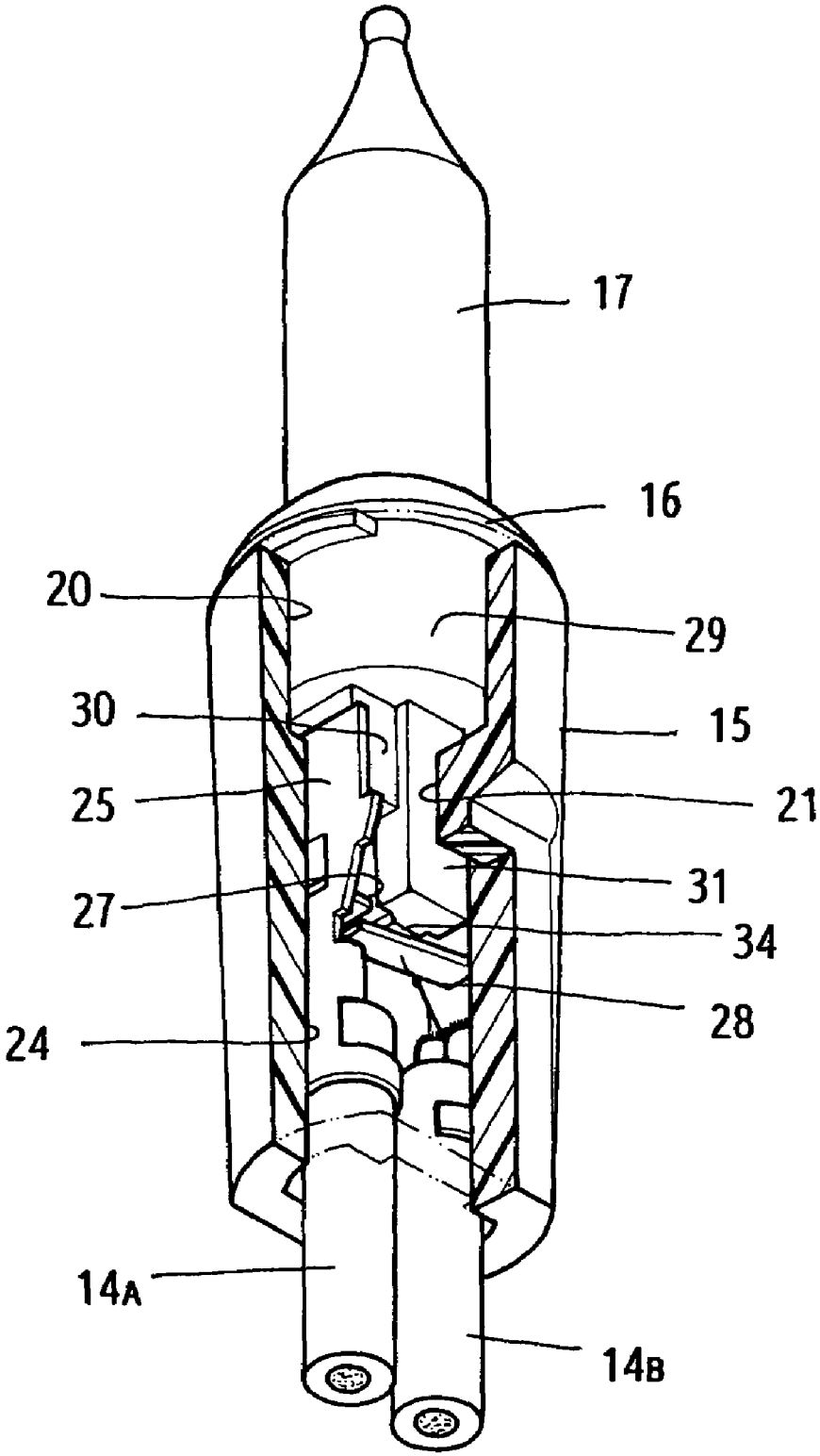
FIG. 4 is a fragmentary section view of the present invention, showing the bulb base plugged in the backstop socket.
Figure 5:
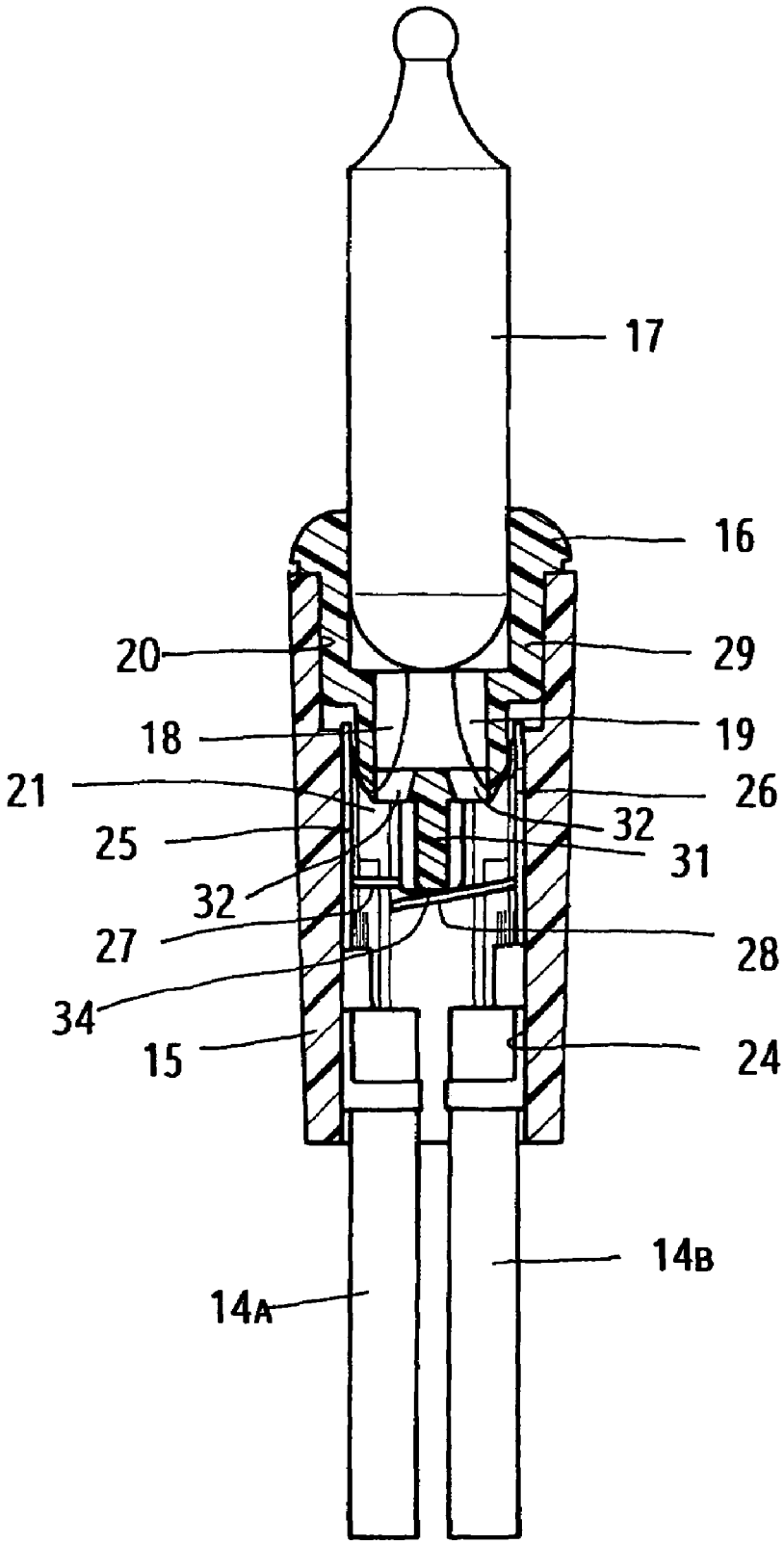
FIG. 5 is a sectional view of the present invention, showing the relation among the parts in the backstop socket.

As shown in FIGS. 3 to 5, the two contact copper plates 25 and 26 in the copper-plate plug grooves 22 and 23 are furnished with two spring reeds 27 and 28 projected vertically out of the two plates 25 and 26 respectively; the spring reed 28 is longer in length than the spring reed 27. The spring reed 28 is mounted in the lower part of the rectangular plug space 21, i.e., in the copper-plate plug groove 23; the spring reed 28 has a given flexibility; when the spring reed 28 is pushed with the rod stub 31 of the bulb base 16, it will move downwards; the other spring reed 27 on the contact copper plate 25 is a shorter one, and is mounted fixedly in the copper-plate plug groove 22. After the bulb base 16 is plugged into the rectangular plug space 21 of the backstop socket 15, the spring reed 28 will be pushed downwards by the rod stub 31 of the bulb base 16 to separate from the spring reed 27; in that case, the power supply will be connected through the bulb 17 to have the lamp string lit up normally.

As shown in FIGS. 1 and 5, the lamp string 11 is made of a plurality of backstop socket 15; each backstop socket 15 is furnished with two spring reeds 27 and 28 to prevent the lamp string from turning off in case of a bulb base 16 being dropped. In the lamp string 11, there is a safety socket assembly 15A without spring reeds 27 and 28; in the safety socket assembly 15A, there is a bulb base 16A which is mounted with a fuse-type bulb 17A. In real use, the spring reeds 27 and 28 in every backstop 15 of the lamp string 11 are pushed with the rod stub 31 in open-circuit state. The power supply will go through the power-supply wire 13, the short power-supply wire 14A, the contact copper plate 25, the copper wire 18 and the tungsten filament of the bulb 17, the contact copper plate 26, and the short power-supply wire 14B in series to light up the lamp string 11 for ornament purpose.

Figure 6:
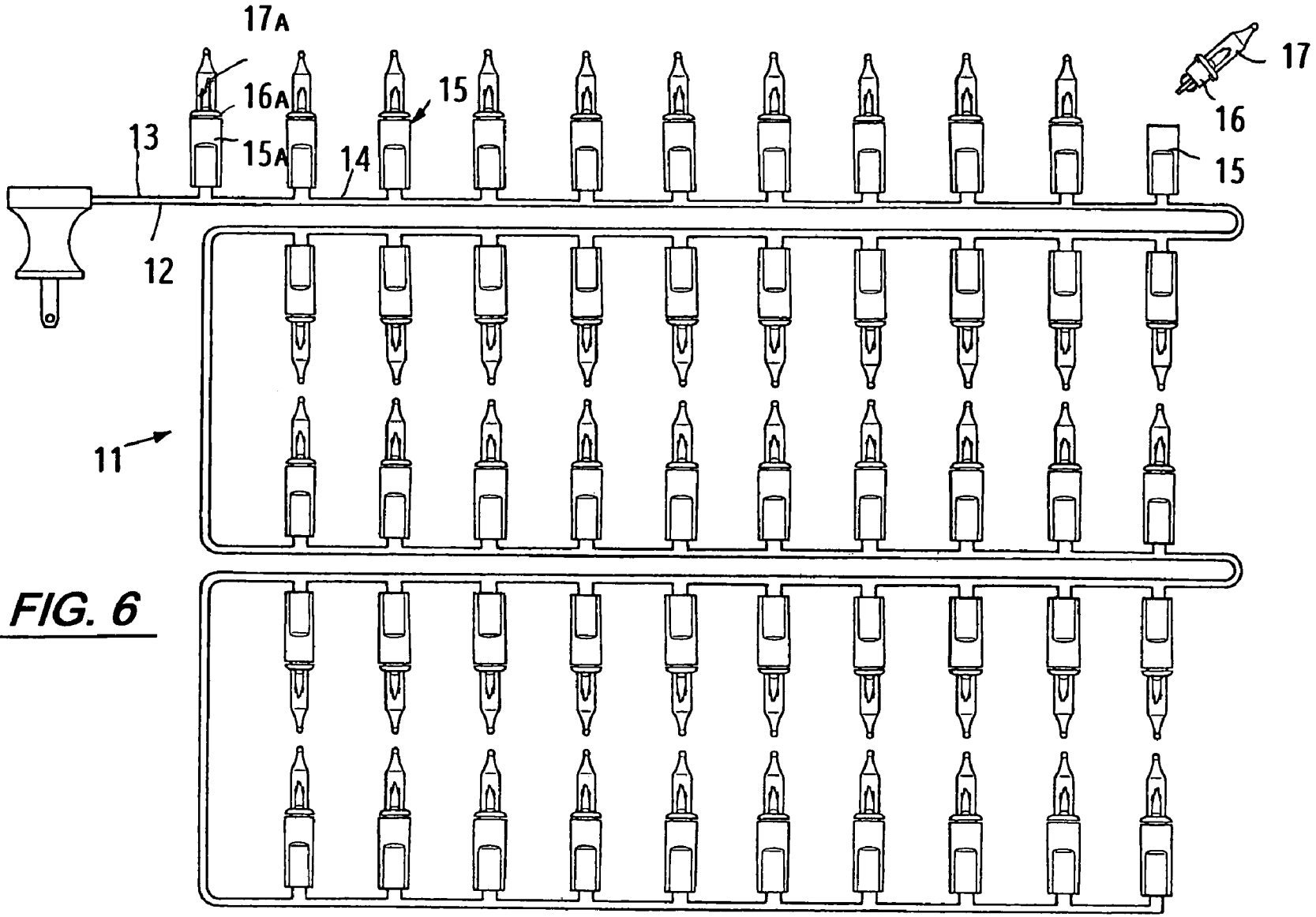
FIG. 6 is a plan view of the present invention, showing a bulb base dropped from the lamp string.

As shown in FIGS. 3 and 6, the lamp string 11 is made of a plurality of backstop sockets 15; in case of one bulb base 16 in a backstop socket 15 being dropped or not mounted in place, the spring reed 28 will move upwards automatically as a result of its resilient force and the pushing force from the rod stub 31 being removed to become in close contact with the spring reed 27 of the contact copper plate 25; in that case, the power supply will be turned on via the two spring reeds 27 and 28 so as to keep the lamp string 11 lit up as usual.

The current in each bulb in the lamp string 11 should not be too high; whenever a bulb base 16 in the lamp string 11 is dropped or missing, the current flows through the rest bulbs 16 will be increased, and an over heating to them will be resulted. In order to prevent overheating danger, the lamp string 11 is added with a safety socket; as soon as the socket lost a bulb base 16 is overheated, the fuse-type bulb 17A will be burned out to cut off the power supply of the lamp string 11 so as to prevent the lamp string form having an overheating danger to burn out a backstop socket 15.

While the invention has been described with reference to specific embodiments it must be understood that those embodiments are susceptible to many changes, substitutions, and modifications that will be readily apparent to those having ordinary skill in the art without departing from the scope and spirit of the invention.

What is claimed is:

1. A backstop socket structure preventing a lamp string from turning off when a bulb is removed, the backstop socket and bulb base combination comprising:

a) a backstop socket having:

i) a round plug cavity located on a top thereof;

ii) a rectangular plug space having first and second copper-plate plug grooves;

iii) a power-supply groove located on a bottom thereof along a longitudinal axis of the backstop socket and having first and second power supply wires located therein;

iv) a first contact copper plate is located in the first copper-plate plug groove and has one end connected to the first power supply wire and a first spring reed protruding inwardly toward a center of the rectangular plug space; and v) a second contact copper plate is located in the second copper-plate plug groove and has one end connected to the second power supply wire and a second spring reed protruding inwardly toward a center of the rectangular plug space and over lapping the first spring reed, the first spring reed has a length shorter than a length of the second spring reed, the second spring reed is movable between connected and disconnected positions; and b) a bulb base having:

i) a cylindrical member located on a first end thereof and having a cavity;

ii) a bulb plugged into the cavity and having two copper wires; and iii) a rectangular block located on a second end thereof and having a rod stub and two through holes, the rod stub protruding downwardly from a center of the rectangular block, one of the two copper wires is inserted through each of the two through holes and located on a side surface of the rectangular block;

wherein, in the connected position, the rod stub is separated from the second spring reed and the second spring reed is connected to the first spring reed, and, in the disconnected position, the rod stub presses the second spring reed downwardly separating the second spring reed from the first spring reed.

2. The backstop socket structure according to claim 1, wherein the second spring reed is located below the first spring reed.

3. The backstop socket structure according to claim 1, wherein the connected position is a normal unbiased position for the second spring reed.

4. The backstop socket structure according to claim 1, wherein the first spring reed is integrally formed with the first contact copper plate, the second spring reed is integrally formed with the second contact copper plate.

* * * * *